US008069644B2

(12) United States Patent
Nevett

(10) Patent No.: US 8,069,644 B2
(45) Date of Patent: Dec. 6, 2011

(54) HELICALLY-WOUND ELECTRIC CABLE

(75) Inventor: Jonathan Nevett, Buizingen (BE)

(73) Assignee: Nexans, Paris (FR)

( * ) Notice: Subject to any disclaimer, the term of this patent is extended or adjusted under 35 U.S.C. 154(b) by 249 days.

(21) Appl. No.: 12/288,849

(22) Filed: Oct. 23, 2008

(65) Prior Publication Data

US 2009/0126969 A1 May 21, 2009

Related U.S. Application Data

(62) Division of application No. 11/342,350, filed on Jan. 26, 2006, now Pat. No. 7,663,058.

(30) Foreign Application Priority Data

Feb. 4, 2005 (EP) ..... 05300095

(51) Int. Cl.
*D02G 3/26* (2006.01)

(52) U.S. Cl. ..... 57/314

(58) Field of Classification Search ..... 57/264, 57/293, 314
See application file for complete search history.

(56) References Cited

U.S. PATENT DOCUMENTS

| | | | | |
|---|---|---|---|---|
| 502,262 | A | 7/1893 | Patterson | |
| 1,475,139 | A | 11/1923 | Pearson | |
| 2,869,316 | A | 1/1959 | Lilly | |
| 3,017,450 | A | 1/1962 | Crosby et al. | 174/34 |
| 3,140,577 | A | 7/1964 | Ash | 57/59 |
| 3,373,550 | A | 3/1968 | Martin | 57/294 |
| 3,651,243 | A | 3/1972 | Hornor et al. | 174/34 |
| 3,715,877 | A | 2/1973 | Akachi | 57/156 |
| 3,884,024 | A | 5/1975 | Oestreich et al. | 57/294 |
| 4,360,137 | A | 11/1982 | Noe et al. | 226/24 |
| 4,574,574 | A | 3/1986 | Knaak | 57/59 |
| 5,564,268 | A | 10/1996 | Thompson | 57/3 |
| 5,647,195 | A | 7/1997 | Josoff | 57/67 |
| 5,739,473 | A | 4/1998 | Zerbs | 174/121 A |
| 5,767,441 | A | 6/1998 | Brorein et al. | 174/27 |
| 6,211,467 | B1 | 4/2001 | Berelsman | 117/113 |
| 6,318,062 | B1 | 11/2001 | Doherty | 57/68 |
| 6,560,390 | B2 | 5/2003 | Grulick et al. | 385/100 |
| 6,875,928 | B1 | 4/2005 | Hayes et al. | 174/113 |
| 6,959,533 | B2 | 11/2005 | Noel et al. | 57/62 |
| 7,392,647 | B2 * | 7/2008 | Hopkinson et al. | 57/237 |
| 2001/0013561 | A1 | 8/2001 | Wild et al. | 242/418.1 |
| 2003/0052148 | A1 | 3/2003 | Rajala | 226/44 |
| 2005/0087361 | A1 | 4/2005 | Hayes et al. | 174/113 |
| 2005/0092515 | A1 | 5/2005 | Kenny et al. | 174/113 |
| 2006/0059883 | A1 | 3/2006 | Hopkinson et al. | 57/236 |
| 2006/0162949 | A1 | 7/2006 | Bolouri-Saransar et al. | 174/113 |

FOREIGN PATENT DOCUMENTS

| | | |
|---|---|---|
| EP | 1174886 | 6/2001 |

* cited by examiner

*Primary Examiner* — Shaun R Hurley
(74) *Attorney, Agent, or Firm* — Sofer & Haroun, LLP

(57) ABSTRACT

A method of manufacturing an electric cable includes winding together two groups in such a manner as to form a group helix, each group having two twisted-together conductor wires, and where the groups are wound together at a speed that varies between two limit speeds having the same sign and in such a manner that the pitch of the group helix varies along the cable between two limit values having the same sign.

3 Claims, 2 Drawing Sheets

HELICALLY-WOUND ELECTRIC CABLE

RELATED APPLICATION

This application is a divisional application of U.S. patent application Ser. No. 11/342,350, filed on Jan. 26, 2006, now U.S. Pat. No. 7,663,058 which claims the benefit of priority from European Patent Application No. 05 300 095.6, filed on Feb. 4, 2005, the entirety of which are incorporated herein by reference.

FIELD OF THE INVENTION

The present invention relates to the field of helically-wound electric cables.

BACKGROUND OF THE INVENTION

An electric cable comprises one or more groups of twisted conductor wires. A group is conventionally constituted by two twisted-together conductor wires—in which case it is called a "pair"—but could equally well comprise more than two twisted-together conductor wires.

A helically-wound electric cable comprises a plurality of groups that are wound together to form a helix.

The term "cross-talk" designates electromagnetic interference between groups belonging to a given electric cable. The cross-talk phenomenon frequently gives rise to problems with data transmission.

In order to reduce cross-talk, it is known to twist the conductor wires together in helixes of pitches that differ from one group to another, in order to prevent the conductor wires of any given group interfitting between the conductor wires of other groups.

U.S. Pat. No. 6,318,062 describes a method of varying the twisting pitch within a pair. That method also serves to prevent the conductor wires being roughly parallel with one another along the cable by preventing the conductor wires of a given group interfitting between the conductor wires of other groups.

Document EP-A-1 174 886 also discloses a helically-wound electric cable comprising at least two groups wound together in such a manner as to form a group helix, each group comprising at least two twisted-together conductor wires, the pitch of the group helix varying along said cable.

Since the frequencies carried by helically-wound electric cables are increasing, it is nowadays necessary to further reduce the phenomenon of cross-talk.

OBJECTS AND SUMMARY OF THE INVENTION

The present invention provides a helically-wound electric cable comprising at least two groups wound together so as to form a group helix, each group comprising at least two twisted-together conductor wires. According to the invention, the pitch of the group helix varies along the helically-wound electric cable between two limit values having the same sign.

Concerning cross-talk, the main coupling mechanism between two pairs is mutual inductance, which is a periodic function of the pair pitches and of the cable pitch that varies along the cable. Consequently, increased interference can occur between the signal conveyed by the pair that is transmitting and the cross-talk signal that propagates in the opposite direction in the pair that is receiving; this phenomenon takes place at frequencies that are in an arithmetical relationship with the period of the above-mentioned periodic function and the speed of propagation. Certain peaks in the curves of cross-talk measured as a function of frequency have their origins in this mechanism, and the more regular and repetitive the structure of the cable over a given length of cable, the more the peaks increase in amplitude and in width. It follows that the amplitudes of these peaks can be reduced by scrambling the geometry of the cable, and in the present invention this objective is accomplished by varying the cable-winding pitch in application of a determined or random function.

The variations in the pitch of the group helix serve to minimize parallelism between the conductor wires, thereby reducing cross-talk.

The helically-wound electric cable of the invention may include at least one additional group helix. Alternatively, the helically-wound electric cable of the invention may comprise a single group helix.

Each group helix may comprise more than two groups.

For example, the helically-wound electric cable may comprise a group helix made up of about ten wound-together groups. Alternatively, the group helix may comprise exactly two groups.

The helically-wound electric cable of the invention may comprise a plurality of group helixes, each group helix having a different number of groups, or indeed the same number of groups.

The groups of twisted-together conductor wires may comprise more than two conductor wires.

Alternatively, each group of conductor wires may comprise exactly two conductor wires: this is known as a "twisted pair".

The conductor wires may be twisted together in helical manner, or in alternating manner, known as the "SZ" manner.

The groups may all have the same number of conductor wires, or the number of conductor wires may differ from one group to another.

Advantageously, the pitch of the group helix varies in application of a function that is periodic, e.g. a sinusoidal function.

Naturally, this characteristic is not limiting, the pitch of the helix may vary in random manner, for example.

The present invention also provides a method of manufacturing a helically-wound electric cable of the present invention. The method comprises a step of winding together two groups so as to form a group helix. According to the invention, the groups are wound together at a speed that varies between two limit speeds having the same sign and in such a manner that the pitch of the group helix varies along the cable between two limit values having the same sign.

The speed that varies between the two limit speeds may be an angular speed at which the two groups are wound around a central line, the central line moving in translation at a linear speed that is substantially constant.

Preferably, the speed that varies between the two limit speeds is a linear speed in translation of a central line, the two groups being wound around the central line at an angular speed that is substantially constant. Such a method makes it possible to avoid varying the angular speed of winding, which can be advantageous, in particular when the inertia of the winding device is relatively high.

The method of the invention may also be implemented without a physical central line, thus making it possible to manufacture a helically-wound electric cable without a central line, with the variable speed either being an angular speed of winding or a linear speed in translation.

More generally, the present invention is not restricted to the way in which the manufacturing method is implemented.

The present invention also provides apparatus for manufacturing a helically-wound electric cable by implementing the method of the invention. The apparatus comprises means for winding two groups so as to form a group helix. According to the invention, the apparatus further comprises means for varying the pitch of the group helix between two limit values having the same sign. The means for varying the pitch of the group helix comprise:

- two accumulators located respectively upstream and downstream from the winder means, each accumulator having a moving drum enabling a varying length of a central line to be retained; and
- control means for controlling the position of each moving drum.

The present invention is not limited by the nature of the means for varying the pitch of the group helixes.

Advantageously, the manufacturing apparatus of the invention comprises means for measuring the stiffness of the central line at the inlet to the winder means, the stiffness measurement means being connected to the control means. The stiffness measurement means enable better control to be achieved over the value of the group helix pitch, but the invention is not limited in any way thereto.

The winder means advantageously comprise:

two reels, each reel serving to carry a supply of one of the groups of twisted conductor wire;

rotary drive means enabling the reels to be moved in rotation about a longitudinal axis;

a distribution plate having two peripheral openings and a central opening, each peripheral opening serving to receive one of the groups of twisted conductor wire, and the central opening serving to receive a central line; and a die at the outlet from the distribution plate.

The invention is naturally not limited by the nature of the winder means.

Advantageously, the manufacturing apparatus further comprises means for applying a binder at the outlet from the die, and two caterpillar-type pullers. Such characteristics are not limiting.

BRIEF DESCRIPTION OF THE DRAWINGS

The invention is described below in greater detail with reference to the figures that correspond merely to a preferred embodiment of the invention.

MORE DETAILED DESCRIPTION

Figure 1:
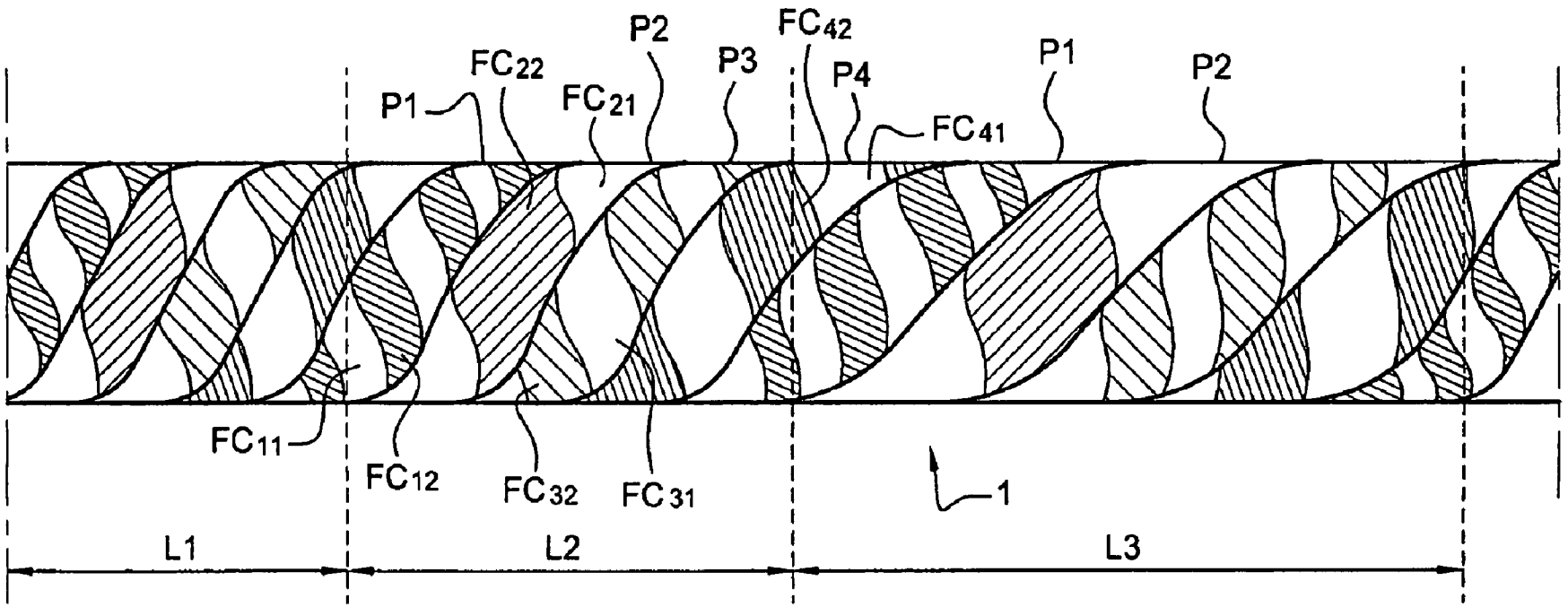
FIG. 1 shows an example of a helically-wound electric cable constituting an embodiment of the present invention.

The helically-wound electric cable shown in FIG. 1 comprises four groups P1, P2, P3, and P4 that are wound together so as to form a helix 1 of groups. Each group Pi, where i lies in the range 1 to 4, comprises two twisted-together conductor wires FCi1 and FCi2, and they are therefore referred to as "pairs".

For each pair Pi, the conductor wires FCi1 and FCi2 are wound together helically, but at a pitch that differs from one pair to another. The pitch of the first pair P1 is thus shorter than the pitch of the second pair P2.

The helically-wound electric cable may also include outer layers (not shown) that protect the helix 1 of groups.

The pitch of the helix 1 of groups varies along the helically-wound electric cable between two limit values. On the sinusoidal segment of electric cable shown in FIG. 1, the pitch of the group helix is shown with a first value L1, a second value L2, and then a third value L3.

The conductor wires of the various pairs P1, P2, P3, and P4 are thus rarely parallel with one another, and when they are parallel, that happens over relatively short distances only.

Figure 2:
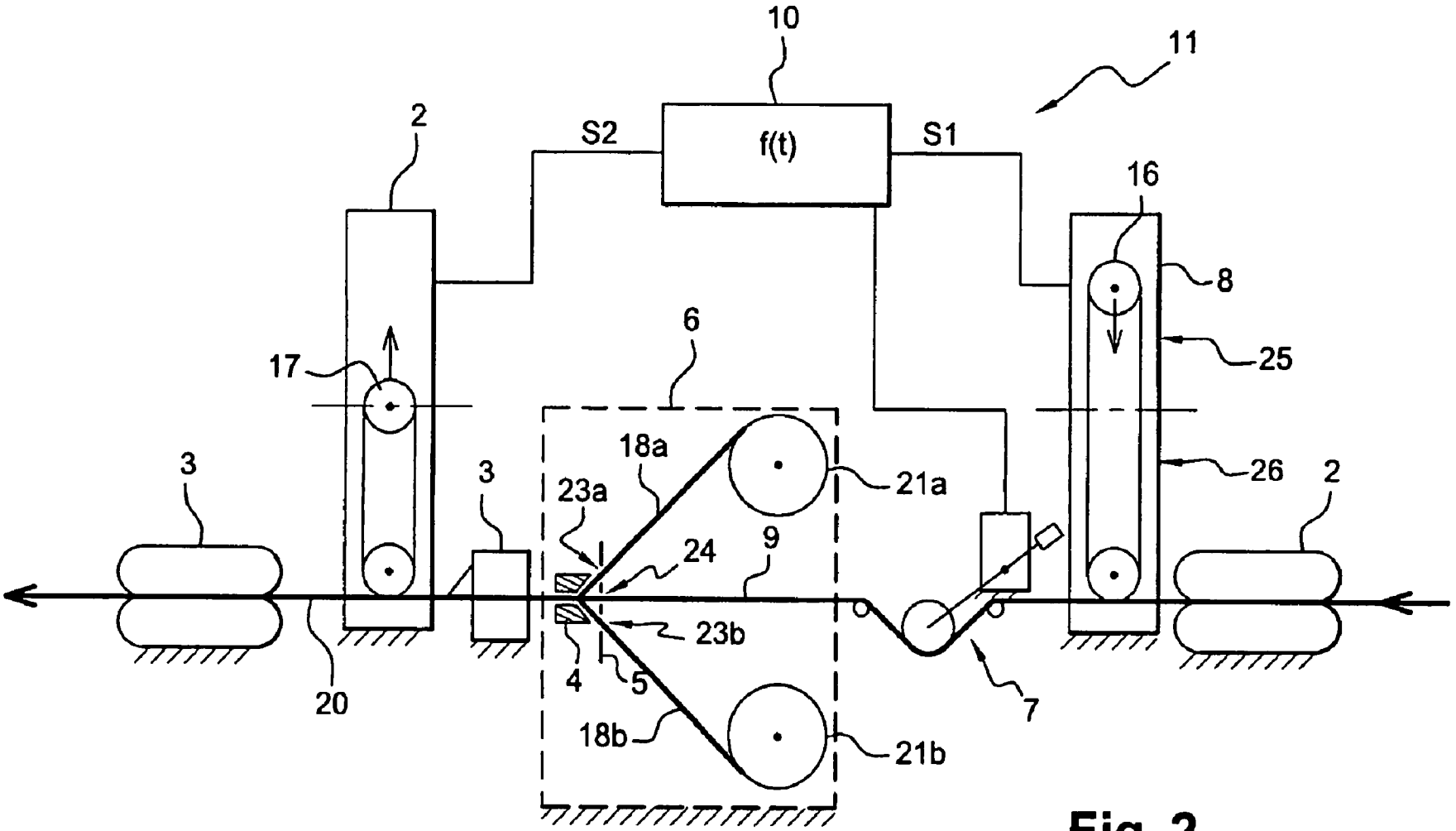
FIG. 2 shows an example of manufacturing apparatus constituting a preferred embodiment of the present invention.

FIG. 2 shows an example of apparatus for manufacturing such a cable. The manufacturing apparatus 11 comprises winder means 6 for winding two groups (18*a*, 18*b*) about a central line 9. The central line 9 is subjected to movement in translation between inlet caterpillars 2 and outlet caterpillars 3.

Each group (18*a*, 18*b*) comprises a plurality of twisted-together conductor wires, e.g. copper wires.

In this example, the winder means 6 carry reels (21*a*, 21*b*). Each reel (21*a*, 21*b*) serves to carry a supply of one of the groups (18*a*, 18*b*). Rotary drive means (not shown) cause the reels (21*a*, 21*b*) to be rotated about the central line 9. The two groups (18*a*, 18*b*) are thus wound so as to form a group helix 20.

The winder means 6 also comprise a distribution plate 5 having two peripheral openings (23*a*, 23*b*) and a central opening 24. Each peripheral opening (23*a*, 23*b*) receives a respective one of the groups (21*a*, 21*b*). The central opening 24 receives the central line 9. The winder means may also comprise a die 4 at the outlet from the distribution plate 5.

At the outlet from the die 4, binder applicator means 3 serve to apply a binder so as to fix the wound groups in position.

The groups (18*a*, 18*b*) are wound about the central line 9 at an angular speed that is substantially constant, e.g. 50 revolutions per minute (rpm). In contrast, the linear speed of the central line 9 varies over time, at least in the winder means 6, such that the group helix 20 presents a pitch that varies along the helically-wound electric cable manufactured in this way.

The linear speed of the central line 9 is substantially constant over time upstream from the manufacturing apparatus 11, and also downstream from the manufacturing apparatus 11, e.g. being equal to 0.1 meters per second (m/s). The linear speed of the central line 9 varies on going through the winder means 6.

The manufacturing apparatus 11 includes means for varying the pitch of the group helix, said means comprising two accumulators (2, 8) disposed respectively upstream and downstream from the winder means 6. Each accumulator (2, 8) comprises a moving drum (16, 17) enabling a varying length of the central line 9 to be retained. The linear speed of the central line 9 varies whenever the position of one or the other of the moving drums (16, 17) varies.

The manufacturing apparatus 11 also comprises control means 10 for controlling the position of each of the moving drums (16, 17). The control means 10 are connected to the accumulators (2, 8). The position of each moving drum (16, 17) is a function of the voltage amplitude of a corresponding control signal (S1, S2), with the control signals (S1, S2) being generated by the control means 10.

For example, when a first control signal S1 is of substantially zero amplitude, a corresponding first moving drum 16 is at half-height in a first accumulator 8. When the first control signal S1 has a positive amplitude, the first moving drum 16 lies in a top half 25 of the first accumulator 8. When the first control signal S1 has a negative amplitude, the first moving drum 16 lies in a bottom half 26 of the first accumulator 8.

The position of a second moving drum 17 in a second accumulator 2 behaves in the same manner depending on the amplitude of a second control signal S2.

The first and second control signal S1 and S2 can be generated in such a manner that at all times their values are opposite. The positions of the first and second moving drums 16 and 17 relative to a mid-line at mid-height in each of the accumulators (2, 8) are thus opposite.

When the moving drums (16, 17) move, the linear speed of the central line 9 through the winder means 6 varies.

Thus, the linear speed of the central line 9 through the winder means 6 is thus likewise substantially equal to the linear speed of the central line upstream from the manufacturing apparatus 11 incremented by a variation term. The variation term is substantially proportional to the first derivative of the first control signal. The variation term can thus be positive, negative, or zero over time.

In order to ensure that the group helix 20 is confined between two limit values having the same sign, it is necessary that the control signals (S1, S2) do not vary too quickly. For example, the linear speed of the central line 9 may vary over the range about 0.075 m/s to 0.12 m/s. With such limit linear speeds, and with an angular speed of about 50 rpm, the helical pitch of the groups varies over the range about 0.9 meters (m) to about 0.14 m. Such values are naturally given merely by way of indication.

The pitch of the group helix 20 may vary in application of a sinusoidal function, for example: in which case the control signals (S1, S2) likewise vary sinusoidally.

The manufacturing apparatus 11 may also include means 7 for measuring the stiffness of the central line 9. The stiffness measurement means 7 are connected to the control means 10 and thus enable the control signals to be adjusted so that the linear speed of the central line at the inlet to the winder means 6 is substantially equal to the linear speed of the central line at the outlet from the winder means 6.

What is claimed is:

1. A method of manufacturing an electric cable said method comprising the steps of:

winding together two groups in such a manner as to form a group helix, each group having two twisted-together conductor wires, and wherein the groups are wound together at a speed that varies between two limit speeds having the same sign and in such a manner that the pitch of the group helix varies along the cable in accordance with a periodic sinusoidal function between two limit values having the same sign.

2. A manufacturing method according to claim 1 in which the speed that varies between the two limit speeds is an angular speed at which the two groups are wound around a central line, the central line moving in translation at a linear speed that is substantially constant.

3. A manufacturing method according to claim 1, in which the speed that varies between the two limit speeds is a linear speed in translation of a central line, the two groups being wound around the central line at an angular speed that is substantially constant.

* * * * *